US011505432B2

(12) United States Patent
Greenberg

(10) Patent No.: US 11,505,432 B2
(45) Date of Patent: Nov. 22, 2022

(54) MUNICIPAL WATER POWERED SHABBAT TRANSPORTATION DEVICE

(71) Applicant: Charles Greenberg, Baltimore, MD (US)

(72) Inventor: Charles Greenberg, Baltimore, MD (US)

( * ) Notice: Subject to any disclaimer, the term of this patent is extended or adjusted under 35 U.S.C. 154(b) by 96 days.

(21) Appl. No.: 16/681,712

(22) Filed: Nov. 12, 2019

(65) Prior Publication Data

US 2021/0139283 A1 May 13, 2021

(51) Int. Cl.

| | |
|---|---|
| ***B66B 9/04*** | (2006.01) |
| ***B66B 1/04*** | (2006.01) |
| ***B66B 11/04*** | (2006.01) |
| ***B66B 1/34*** | (2006.01) |
| ***B66B 1/26*** | (2006.01) |

(52) U.S. Cl.

CPC ..... *B66B 9/04* (2013.01); *B66B 1/04* (2013.01); *B66B 1/3407* (2013.01); *B66B 1/3469* (2013.01); *B66B 11/0423* (2013.01); *B66B 1/26* (2013.01)

(58) Field of Classification Search

CPC ..... B66B 9/04; B66B 1/04; B66B 1/3407; B66B 1/3469; B66B 1/26

USPC ..... 187/272

See application file for complete search history.

(56) References Cited

U.S. PATENT DOCUMENTS

| | | | | |
|---|---|---|---|---|
| 5,346,038 | A * | 9/1994 | Rehfeld | B66B 9/04 187/273 |
| 10,611,600 | B2 * | 4/2020 | Morrison | F15B 11/04 |
| 10,669,128 | B2 * | 6/2020 | Robbins-Capuano | B66B 5/028 |
| 2013/0126277 | A1 * | 5/2013 | Friedman | B66B 3/00 187/384 |
| 2014/0174860 | A1 * | 6/2014 | Yakuel | B66B 9/04 187/272 |
| 2014/0364272 | A1 * | 12/2014 | Shapira | B66B 11/0484 477/3 |
| 2019/0092602 | A1 * | 3/2019 | Harel | B66B 5/0025 |
| 2019/0127177 | A1 * | 5/2019 | Derbarmdiger | B66B 1/26 |
| 2020/0262677 | A1 * | 8/2020 | Samba Murthy | F15B 11/10 |

* cited by examiner

*Primary Examiner* — Jeffrey Donels

(57) ABSTRACT

The present invention is a device for moving people or items on the Jewish Sabbath and certain Jewish holidays in a manner that is widely acceptable within Jewish Law through powering and controlling this invention with municipal water. The invention includes applying this technology to elevators, escalators, dumbwaiters, conveyors, stair lifts, porch lifts, and more. Within the invention are certain components and groups of components that are unique in their arrangement and purpose.

2 Claims, 6 Drawing Sheets

MUNICIPAL WATER POWERED SHABBAT TRANSPORTATION DEVICE

CROSS-REFERENCE TO RELATED APPLICATIONS

Not applicable

STATEMENT REGARDING FEDERALLY SPONSORED RESEARCH OR DEVELOPMENT

Not applicable

THE NAMES OF THE PARTIES TO A JOINT RESEARCH AGREEMENT

Not applicable

INCORPORATION BY REFERENCE OF MATERIAL SUBMITTED ON A COMPACT DISC OR AS A TEXT FILE VIA THE OFFICE ELECTRONIC FILING SYSTEM (EFS-WEB)

Not applicable

STATEMENT REGARDING PRIOR DISCLOSURES BY THE INVENTOR OR A JOINT INVENTOR

Not applicable

BACKGROUND OF THE INVENTION

Using a standard elevator on the Sabbath (and on certain holidays) is prohibited for observant Jews for reasons mainly centered around the prohibition of actively turning on, turning off, or causing a direct change to a flow of electricity on these days. The Jewish Sabbath starts at Friday night and continues until Saturday night. Jewish Holidays also begin at night and end at night. Observant Jews are prohibited from many types of 'work' during the Sabbath and during certain holidays. Electrically powered and electrically controlled elevators, with modifications such as automatically stopping at all, or a sequence of floors, either continually or on a predetermined schedule, and with other modifications, are used by a significant number of observant Jews on the Sabbath.

There are important and influential giants of deciding Jewish law (Rabbis), who find these modified elevators unacceptable for Sabbath use. Others forbid them for healthy Jews. Many observant Jews follow the restrictions of not using these elevators on the Sabbath. The details of this difference of understanding are beyond the scope of this background statement.

Observant Jews use large municipal water systems on the Sabbath. An elevator, platform lift, dumbwaiter, escalator, conveyor or other device used to transport people or other items, either vertically, horizontally, or some combination thereof powered by municipal water or steam, solve problems that those giants of deciding Jewish law have with the currently available options concerning Sabbath use. This inventor hopes all will agree that this municipal water powered device is acceptable for use on the Sabbath.

(1) Field of Invention

The present invention relates to a device for moving people or items on the Jewish Sabbath and certain Jewish holidays in a manner that is widely acceptable within Jewish Law through powering this invention with municipal water or steam

(2) Description of Related Art Including Information Disclosed Under 37 CFR 1.97 and 1.98

Not applicable

BRIEF SUMMARY OF THE INVENTION

As stated in the 'FIELD OF INVENTION' above, the present invention relates to a device for moving people or items on the Jewish Sabbath and certain Jewish holidays in a manner that is widely acceptable within Jewish Law through powering this invention with municipal water or steam.

This invention in its simplest form accomplishes Sabbath acceptance by extending a single acting hydraulic cylinder or turning a hydraulic motor by way of a connection to the municipal water or steam system to power the lift of a platform or turning a winch or conveyor. Throughout this application municipal water includes steam and each mechanical alternative is for the purpose of Sabbath acceptance.

In the case of the hydraulic cylinder lifting a load (such as in an elevator, dumbwaiter, or platform lift), the water enters the hydraulic cylinder by way of a valve (or another set up that regulatory demands can be solved with mechanical, hydraulic, or other methods, which are acceptable within Jewish law as designed into this invention.

Making the elevator (or platform lift, etc.) comparable in operation and feel to other elevators often may require, in addition to being attractive and ascetically pleasing, a control at each landing to retrieve the elevator platform, a smooth and quick operation free of jerks and severe stops, and others. These features can be accomplished with mechanical, hydraulic, or other methods which are acceptable within Jewish law.

Making the elevator (or platform lift, etc.) economically viable, user friendly, environmentally sound for water conservation, and code compliant may require the option of shifting from the Sabbath mode, which in its basic design does not recycle water, to a weekday mode, which recycles the water by way of a reservoir and pump and possibly adds electrical components to add to the safety, comfort, and regulatory compliance. Some methods of shifting from Sabbath and weekday modes can be as follow:

- by manually shifting certain auxiliary valves and flipping one or more electrical switches
- by using a parallel control (FIG. 4) within the elevator platform and at each landing which on weekdays activates the pump as needed, electrical components as needed, and any other non-Sabbath features as needed,
- by interfacing with available data that shifts the modes at the proper times, by timers, or by some other method.

The use of the word hydraulic in this section, when used in reference to Sabbath mode, normally includes directing the municipal water or municipal steam and its energy (water pressure) through the pipes, hoses, valves, cylinders, and/or other components to a hydraulic cylinder or hydraulic motor to accomplish the desired result.

This invention will allow far greater mobility on the Sabbath for those in need and those who refuse to use electric Shabbat elevators because of the Rabbinic opinions that electric elevators are forbidden on the Sabbath. An additional benefit of this water operated elevator is that it can be operated on demand, whereas for those that allow the electric Sabbath elevators, the elevators wear and waste energy by operating continually at whatever interval is set.

Figure 1:
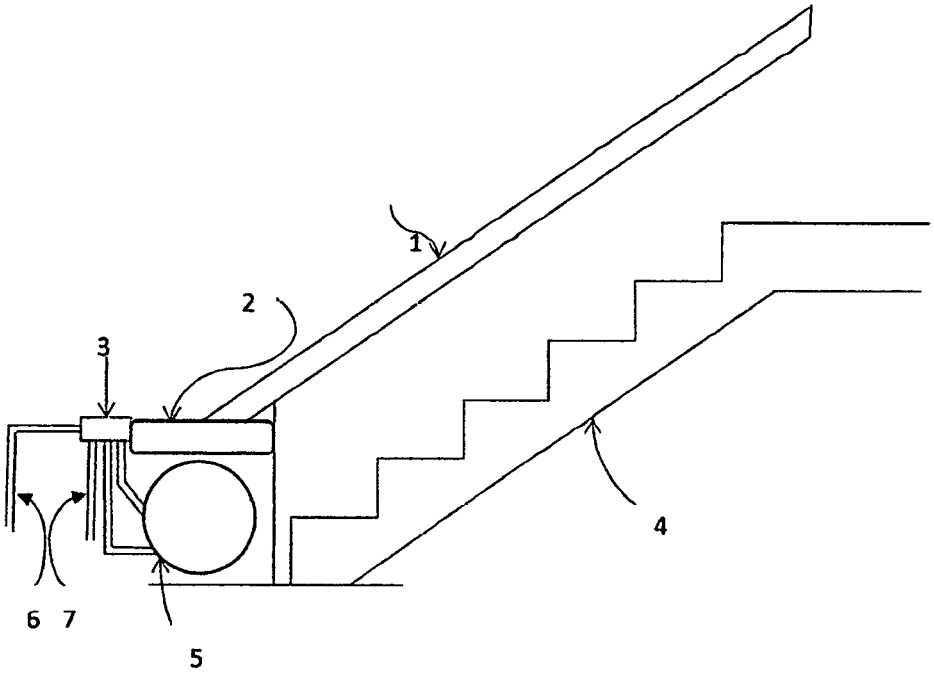
FIG. 1—Stairlift

This drawing shows an application of this invention using municipal water 6 to power a diagonal lift/movement of a seat 2 on its track 1 using a water powered hydraulic motor 5 (as opposed to the hydraulic cylinder) for accomplishing movement up the stairs 4. The pictured simple hydraulic circuit depicts a valve 3, municipal water line 6, and the dump to sewer line 7.

Figure 2:
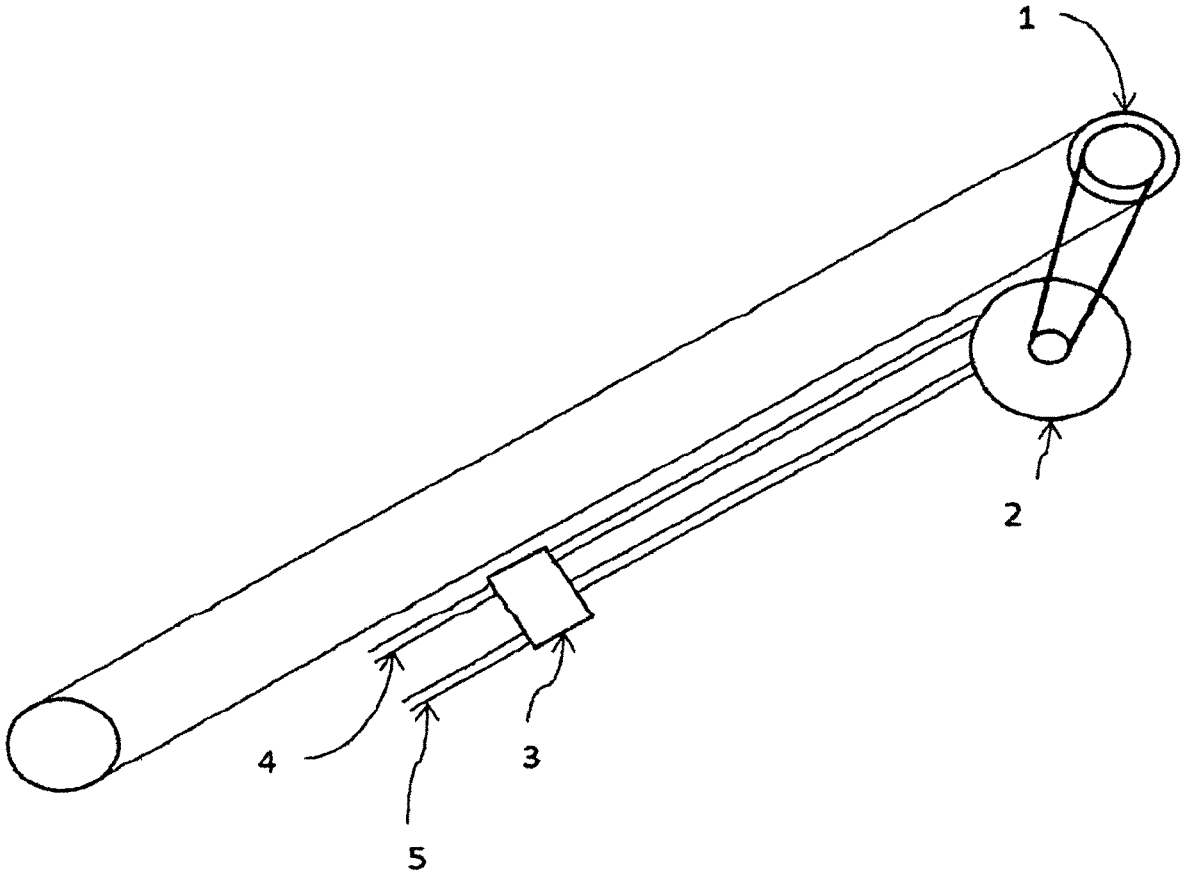

FIG. 2—Conveyor/Escalator

This drawing shows more applications of this invention using municipal water to power conveyor/escalator using a water powered hydraulic motor 2 turning sprocket/pulley 1 and in turn, turning the conveyor/escalator. The pictured hydraulic circuit depicts the valve 3, municipal water line 4, and the dump to sewer line 5.

Figure 3:
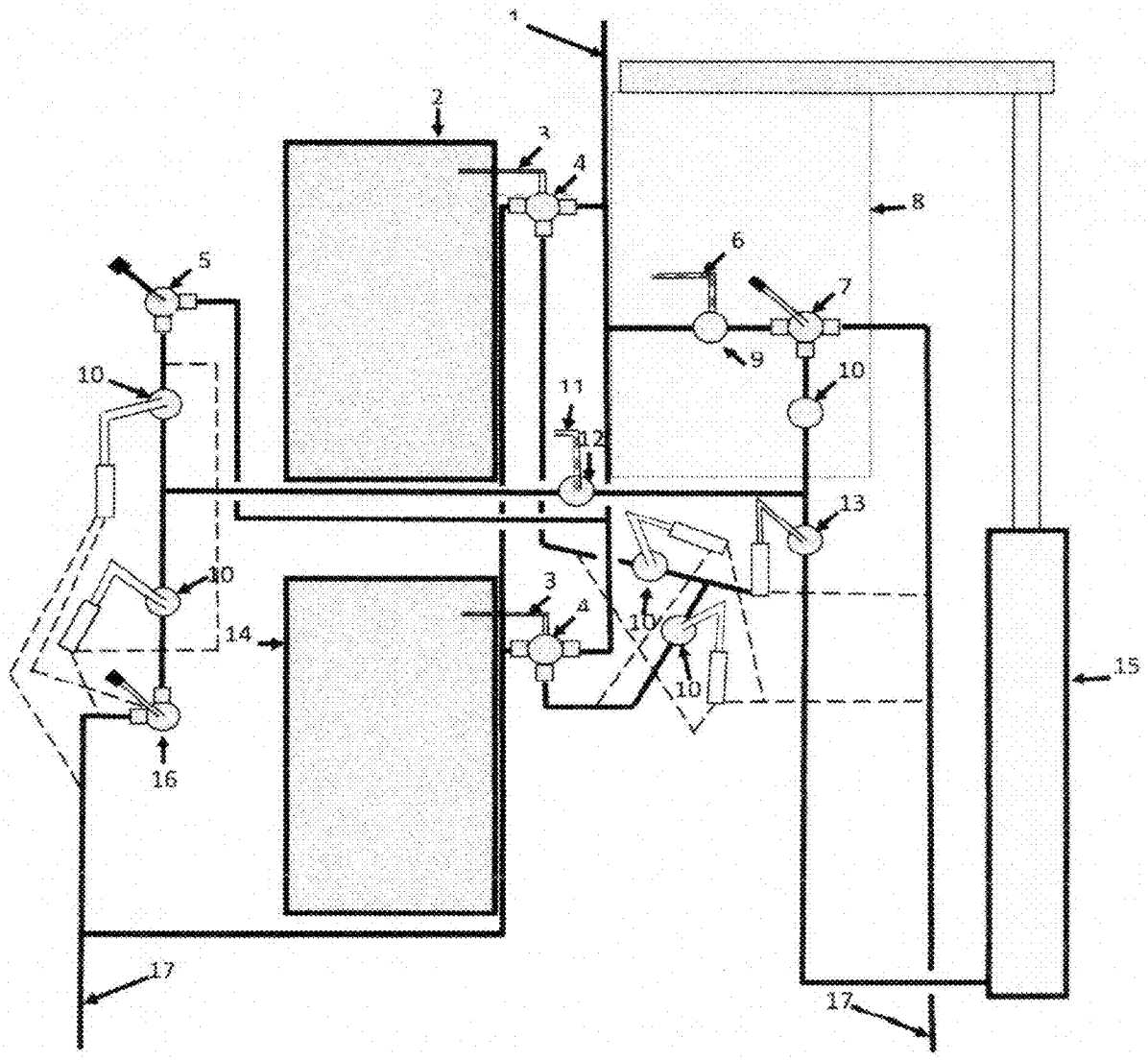

FIG. 3—Elevator with Hydraulic Circuit

This drawing shows a basic layout of a two-story elevator using a hydraulic cylinder 15 powered by municipal water 1. The pictured hydraulic circuit depicts the incoming municipal water line 1 and the exiting dump to sewer lines 17 and the two landing doors 2 and 14. Three manual control directional) valves are pictured—control 7 inside the cab 8, second floor cab retrieval valve 5, and first floor cab retrieval valve 16. Three manually actuated safety valves are pictured—two valves 4 with their actuator arms 3, which sense an open landing door (and in turn shut off water to and from the hydraulic cylinder) and a shut of valve 9 and its actuator arm 6, which senses the internal cab door (not pictured) being open (and in turn shuts off water to the cab control valve 7. Hydraulically activated valve 13 shuts off flow to and from the hydraulic cylinder 15 when landing doors are open. Hydraulically activated valves 10 throughout this hydraulic circuit are used to selectively isolate various lines as necessary and use dashed lines to each spring-loaded valve's hydraulic cylinder for activation and dumping. Specific valves have yet to be determined, and as such the exact line layout cannot yet be depicted. This layout approximates the necessary components, but not necessarily an exact hydraulic circuit.

Figure 4:
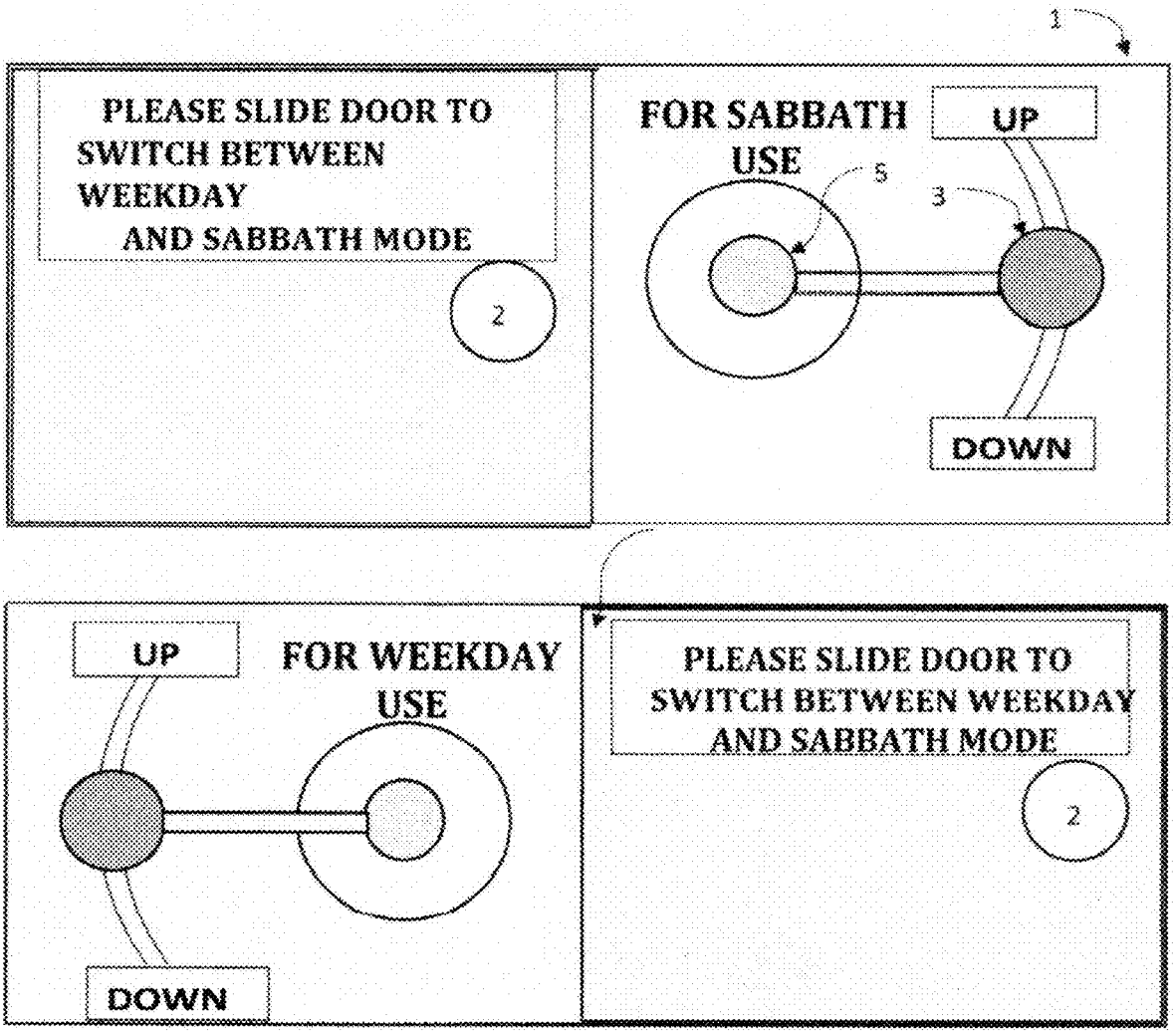

FIG. 4—Dual Operating Controls

This drawing shows a cabinet with parallel controls in the elevator cab and at each landing—one control for Sabbath and one control for weekdays. Sliding door 4 from left to right or visa-versa by use of a knob (or other similar item) 2 determines which control is accessible and which mode the elevator is in. The text on the control units will be visible on the control units to guide the users. Attached to the control valve (not visible) 5 is the handle/knob 3 that instructs the cab to move up or down.

Figure 5:
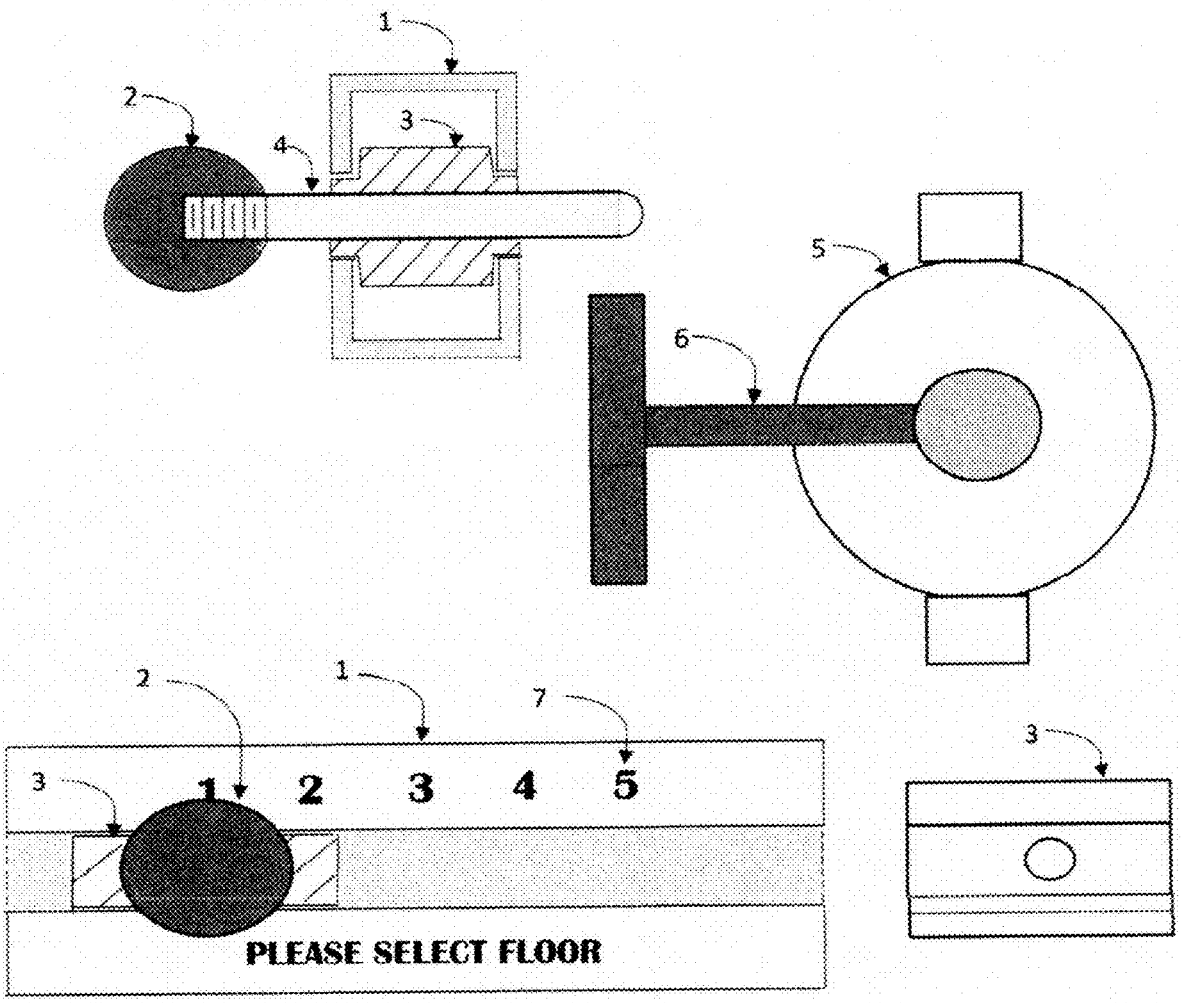
Figure 6:
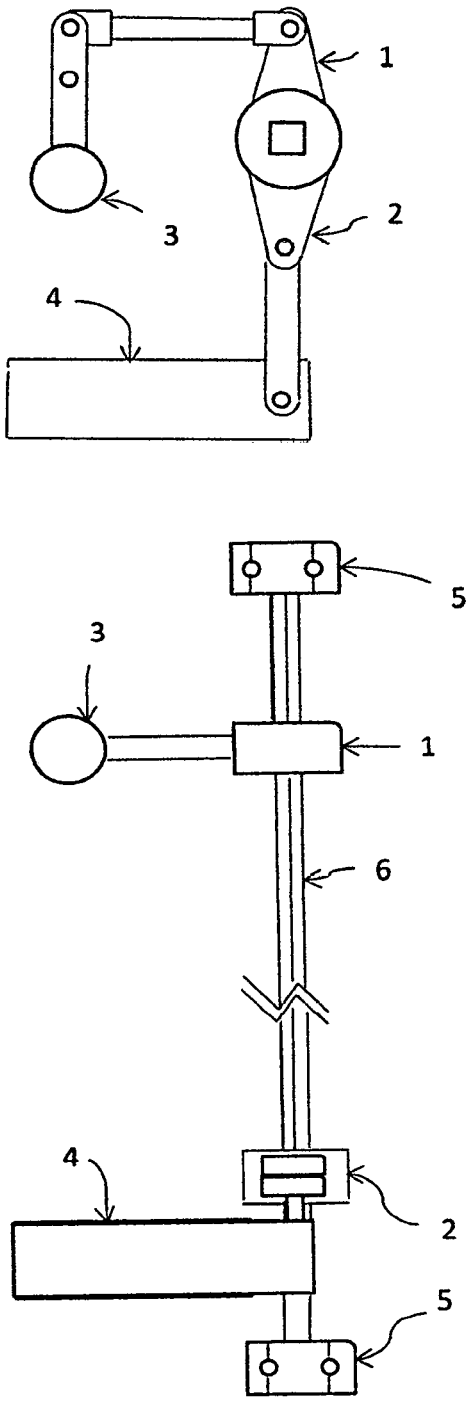

FIG. 5—Actuator to Cushion and Stop Cab at Desired Landing

This drawing shows one alternative for selecting desired landing by sliding a knob and attached actuator (shaft with rounded end in this drawing) which places that actuator directly in line to contact a landing valve located near the desired landing. The stationary landing valves are staggered at each floor in order to align with the position of the actuator at each control positioning (selection). Upon the actuator contacting the landing valve, flow to the elevator begins to be restricted, causing the elevator to slow and finally stop when the valve is completely closed.

Floor (landing) selector body 1 contains a sliding member 3 with actuator shaft 4 penetrating it, extending to the front (left) for the attachment of a hand knob 2, and to the rear (right) a rounded end which will contact a t-lever 6 to cushion and stop the elevator travel at the selected floor. Actuator can contact and shift valve from the top or bottom of the t-lever depending on direction of travel.

FIG. 6—Linkage

This drawing shows one example of using linkage as opposed to hydraulics for some of the functions. The top drawing looks down upon the linkage from the elevator cab to the directional valve 4 at the bottom of the elevator. The elevator passenger shifts knob 3 which pivots the upper linkage 1, which in turn rotates square rod (or splined or other) 6 and its lower linkage arm 2 to shift valve 4, causing the water to either enter or exit the lift cylinder causing the elevator to either rise or descend. Bearing 5 hold the square rod in position, while upper linkage 2 (attached to the elevator cab) slides up down on square rod 6.

DETAILED DESCRIPTION OF THE INVENTION

The following description will predominantly focus on the application of this invention to elevators. This invention has many additional applications and configurations. Specific examples and descriptions throughout this document are for illustration purposes only. These examples and descriptions in no way are meant to limit the scope of this invention or the possible applications of this invention.

This description will start with the most basic configuration and continue with more complex variations.

Simplest Form—Two Levels, Single Acting Hydraulics, No Safeties or Cushioning

In its simplest form a Shabbat elevator encompasses a platform (FIG. 3 #8), framework, track, hydraulic cylinder (FIG. 3 #15), and control valve (FIG. 3 #7) connected to the municipal water system. (FIG. 3 #1)) When the platform is in the down position, the valve has dumped the water from the hydraulic cylinder (either to a sewer line (FIG. 3 #17), storage tank, a pond, or elsewhere) while blocking the flow of municipal water (FIG. 3 #1) into the hydraulic cylinder (FIG. 3 #15). When the platform is to rise, the valve (FIG. 3 #7) is positioned to allow the municipal water at its delivery pressure to enter the hydraulic cylinder (FIG. 3 #15) below the piston, which results in the cylinder rod extending and raising the attached platform (FIG. 3 #8) until the full stroke has been achieved. When the platform is in the up position, the valve (FIGS. 3 #7) prevents the water from flowing out of the hydraulic cylinder by either maintaining the pressurized municipal water flowing into the hydraulic cylinder or by shutting off the flow and preventing flow out of the cylinder. When the platform is to descend, the valve (FIG. 3 #7) is positioned to allow the water in the hydraulic cylinder to dump (either to a sewer line (FIG. 3 #17), storage tank, a pond, or elsewhere). Applications for this simple design might include free standing handicapped lifts, basic dumbwaiters, dock lifts or low-cost elevator applications where there are no code restrictions.

Standard Form—Two Levels, Single Acting Hydraulics, Door Safeties, and Cushioning The addition of door safeties allows an added degree of safety for the operation of the elevator. Each level (FIGS. 3 #2 & #14) (FIG. 3 #8) will have a locked door when the elevator cab is not positioned at the door. The door will be released either hydraulically or mechanically by contacting the cab directly or through linkage. The elevator will not be allowed to move if one of these doors (FIGS. 3 #2 & #14) is open. A gate in the cab can isolate the moving elevator passengers from contacting the stationary walls and doors outside of the cab. This gate can be linked to the safety system (FIGS. 3 #9 & #6) in such a fashion that the cab will not move until the gate is closed if operated from within the cab. Hydraulically, these safeties will either directly cut flow off from or to the hydraulic cylinder or cut flow from or to the cab's control valve directly or through a hydraulic control circuit. All other hydraulic circuitry will be similar to 'simplest form' described above.

Deluxe Form—Two Levels, Single or Double Acting Hydraulics, Door Safeties, Controls at Each Level to Retrieve the Elevator, and Cushioning The addition of controls (FIGS. 3 #5 & #16) at each level will add considerably to the functionality of the elevator. The elevator will be able to be recalled to the other floor remotely from a control valve at each level. Hydraulically, this will complicate the circuitry even more. The circuitry will isolate the operation of the activated control valve from the operation of the other two control valves. This means that operating the cab's control valve (FIG. 3 #7) will make the fixed control valves (FIGS. 3 #5 & #16) at each level inoperable. Operating one of the fixed control valves to retrieve the cab will make the cab's and the other floor's control valves inoperable. The safety circuitry (FIGS. 3 #9 & #6 for the gate inside the cab which prevents the operation of the elevator from the cab when not in the closed position should not prevent the retrieval of the cab from the other levels if the gate is not closed.

Cushioning will be accomplished either by cushioning valves, by a cushioned hydraulic cylinder(s) or by other means. A double acting hydraulic cylinder(s) may be necessary when all cushioning is to be accomplished by the cylinder(s) (FIG. 3 #15) or by other means. A double acting hydraulic cylinder(s) may be necessary when all cushioning is to be accomplished by the cylinder(s) itself.

Multilevel Form—Three or More Levels, Single or Double Acting Hydraulics, Door Safeties, Controls at Each Level to Retrieve the Elevator, and Cushioning.

The addition of additional levels will continue to add to the complexity of the hydraulic circuitry but operate under the same principles as the two-level versions. After adding appropriate control and other valves, the challenge of softly and accurately stopping the cab at each level using only municipal water can be accomplished in multiple ways as follow:

Precise cylinder stroke—The cylinder (FIG. 3 #15) can be manufactured to a specific length, with or without internal cushioning to accurately move between two levels. If additional levels are required, additional cylinders of precise stroke can be stacked (with or without a framework) in such a way that each cylinder can operate independently or with other selected cylinders to accurately reach or descend to the desired level. Alternatively, these multiple cylinders could be of specific length and placed side-by-side to operate a cable reeving system that would accurately move the cab to the desired position.

Staggered shut (cushioned or not) off valves at each level—In this scenario the cab will have a horizontally sliding actuator (FIG. 5) positioned to mechanically contact the staggered valve at each level to stop the load at that predetermined level. The elevator lift power will come from a hydraulic cylinder(s) of a stroke equal to or greater than the maximum travel of the elevator, a stack of cylinders with a total stroke equal to or greater than the maximum travel of the elevator, a cable system operated by a water motor driven winch (operated with municipal water a reeving system operated with hydraulic cylinders which can have a combined stroke equal to the travel of the cab or combined hydraulic cylinders either shorter or longer than the travel of the cab through the arrangement of pulleys and cables using multi-part lines Water operated limit switches—The use of the staggered shutoff valves, and other hydraulic safeties and sensing devices can function very much like an electrical limit switch system. These added valves and safeties can further complicate the circuitry by adding control circuitry to the entire system to activate and deactivate functions as the cab reaches various positions.

Weekday Form with Sabbath Function

During weekdays when there is no prohibition on electricity and 'work', the elevator can operate from a reservoir and pump, or by an electric winch, with electrical controls, or by any other variation and features found in other elevators. The Sabbath function will turn off or simply not activate all of these prohibited features (prior to the Sabbath beginning), while activating those functions necessary for Sabbath operation. This shifting to and from the Sabbath function can be accomplished in various ways which can include points below or a combination thereof as follow:

Manually redirect from the municipal water to a reservoir; activate the (water) pump to supply pressurized water as needed from the reservoir; redirect the water dumped by the retracting cylinder to the reservoir.

Have dual controls (FIG. 4) in the cab and at each level so that by choosing the Sabbath controls all prohibited weekday functions will not operate (resume). All weekday functions can resume by simply choosing the weekday controls.

Automatic switching between Sabbath and weekday mode can be accomplished by a dedicated or remote computer monitoring the exact times and dates that the Sabbath function needs to operate in conjunction with electrically operated weekday valves and manual Sabbath day valves (possibly, appropriate valves are available that can operate both electrically and manually). Automatic activation of the necessary switching will remove concerns that manual switching might be forgotten until the switching would be prohibited on the Sabbath, making the elevator unusable on the Sabbath.

Automatic switching between Sabbath and weekday mode can be accomplished by preset timers.

In some cases, the Sabbath function could be added to an existing elevator installation.

With all of these features and functions are certain inventions, but the real invention is the concept of an elevator (and other devices), operable under Jewish Law by observant Jews on the Sabbath, because of its being powered by and controlled by municipally supplied water at its delivery pressure.

This invention will allow far greater mobility on the Sabbath for those in need and those who refuse to use electric Sabbath elevators because of the Rabbinic opinions that the electric elevators are forbidden on the Sabbath. An additional benefit of this water operated elevator is that it can be operated on demand, whereas for those who allow the use of electric Sabbath elevators, the elevators wear and waste energy by operating continually at whatever interval is set.

It will be apparent to one with skill in the art that the transportation system and/or skilled in Sabbath compliance of the invention may be provided using some or all of the mentioned features and components without departing from the spirit and scope of the present invention. It will also be apparent to the skilled artisan that the embodiments described above are specific examples of a single broader invention which may have greater scope than any of the singular descriptions taught. There may be many alterations made in the descriptions without departing from the spirit and scope of the present invention.

The invention claimed is:

1. A transportation device powered by a municipal water and/or steam system and the pressure contained in the municipal water system, causing movement of a platform, seat, conveyor, escalator, elevator cab, or product, to accomplish Sabbath compliance by solving objections to electrically operated Sabbath elevators and solving issues with other transportation devices by incorporating technology to accomplish Sabbath compliance, comprising:

a connection of municipal water system to a hydraulic circuit including a hydraulic driving source to convert the energy in the municipal water and its water pressure into a usable energy source to create motion to move the load, or connection of municipal water to a more complex hydraulic circuit containing a driving source (hydraulic cylinder, hydraulic motor, or other device converting the energy in the water and its water pressure into a usable energy source to energize and create motion) and a combination containing one or more of components comprising filters, sensing devices, a series of valves to control a combination of valves or hydraulic circuit components to move the load;

a hydraulic circuit with or without a municipal water and/or steam control circuit to activate and allow, not allow, increase, or restrict the flow of municipal water to the driving source;

mechanically operated controls and safeties activated by direct or indirect contact with the load, by linkage, by sudden motions of the load, by human action, by load sensing, or by pressure sensing;

electrical components to provide safety features in a Sabbath mode or to power the transportation device in an alternate mode consistent with weekday use.

2. A transportation device powered by a municipal water and/or steam system and the pressure contained in the municipal water system, causing movement of a platform, seat, conveyor, escalator, elevator cab, or product, to accomplish Sabbath compliance by solving objections to electrically operated Sabbath elevators and solving issues with other transportation devices which can incorporate technology to accomplish Sabbath compliance and be optionally shifted into a non-Sabbath mode comprising one or more of:

a device to shut off of the incoming municipal water (either manually, hydraulically, electrically, or electronically) to a Sabbath compliant hydraulic circuit and action of an electrically or combustion powered device to pressurize and deliver pressurized liquid;

an alternate weekday operator control which activates a desired non-Sabbath compliant component(s) on demand, while having Sabbath operator controls available for immediate use at all times;

a remote electronic interface or preset timer(s) recognizing exact times necessary to protect against Sabbath or holiday violation, set to shift the transportation device between Sabbath and weekday mode at appropriate times;

a weekday mode control, when activated, comprising the use of a hydraulic circuit, with the use of an electrically powered device or combustion powered device to pressurize and replace the constant municipal water supply with a liquid contained in a reservoir or the use of a hybrid system, incorporating the hydraulic circuit and the other controls to shift between Sabbath and weekday modes.

* * * * *